US005609259A

United States Patent [19]

Menard

[11] Patent Number: 5,609,259

[45] Date of Patent: Mar. 11, 1997

[54] MODERN TOOTHBRUSH HOLDER

[76] Inventor: Richard Menard, P.O. Box 698, Hollywood, Md. 20636

[21] Appl. No.: 405,091

[22] Filed: Mar. 16, 1995

[51] Int. Cl.[6] ..... A47F 7/00

[52] U.S. Cl. ..... 211/66

[58] Field of Search ..... 211/60.1, 65, 66; 248/110, 111; D6/534, 528, 531

[56] References Cited

U.S. PATENT DOCUMENTS

| | | | |
|---|---|---|---|
| D. 62,479 | 6/1923 | Erickson . | |
| D. 65,357 | 7/1924 | Strnad . | |
| D. 67,989 | 8/1925 | Balmer . | |
| D. 154,940 | 8/1949 | Mayer . | |
| D. 161,425 | 1/1951 | Cleverdon . | |
| D. 162,224 | 2/1951 | Ricard . | |
| D. 176,162 | 11/1955 | Steece . | |
| D. 219,599 | 12/1970 | Rams et al. . | |
| 670,481 | 3/1901 | Kirkwood . | |
| 712,824 | 11/1902 | Masland . | |
| 1,005,985 | 10/1911 | Lebherz . | |
| 1,108,043 | 8/1914 | Weder et al. . | |
| 1,242,017 | 10/1917 | Mendelsohn . | |
| 1,291,349 | 1/1919 | Ackers . | |
| 1,544,694 | 7/1925 | Speidel | 211/65 X |
| 1,629,213 | 5/1927 | Hughes | 211/65 X |
| 2,074,248 | 3/1937 | Barbour . | |
| 2,642,331 | 6/1953 | Sprinkle | D6/534 X |
| 3,968,950 | 7/1976 | Gallo . | |
| 3,995,743 | 12/1976 | Blackburne . | |

*Primary Examiner*—Ramon O. Ramirez
*Assistant Examiner*—Sarah L. Purol
*Attorney, Agent, or Firm*—Robert Platt Bell & Associates, P.C.

[57] ABSTRACT

A toothbrush holder comprises a generally planar support plate having at least one L-shaped slot formed at the periphery thereof, the L-shaped slot has a necked portion for retaining the toothbrush. The L-shaped slot may have a major axis and a minor axis. The minor axis of the L-shaped slot may intersect the periphery of the support plate. The necked portion may be provided at a position on the major axis of the L-shaped slot, positioned approximately halfway along the major axis of the L-shaped slot. In a second embodiment of the present invention, the L-shaped slot may be provided with a countersunk or counterbored portion provided along the major axis of the L-shaped slot to retain a toothbrush. The countersunk or counterbored portion may be provided at an end of the L-shaped slot furthest from the minor axis. In a third embodiment of the present invention, a milled portion may be provided along the major axis of the L-shaped slot to retain a toothbrush. The milled portion may be provided at an end of the L-shaped slot furthest from the minor axis.

24 Claims, 7 Drawing Sheets

200

200

400

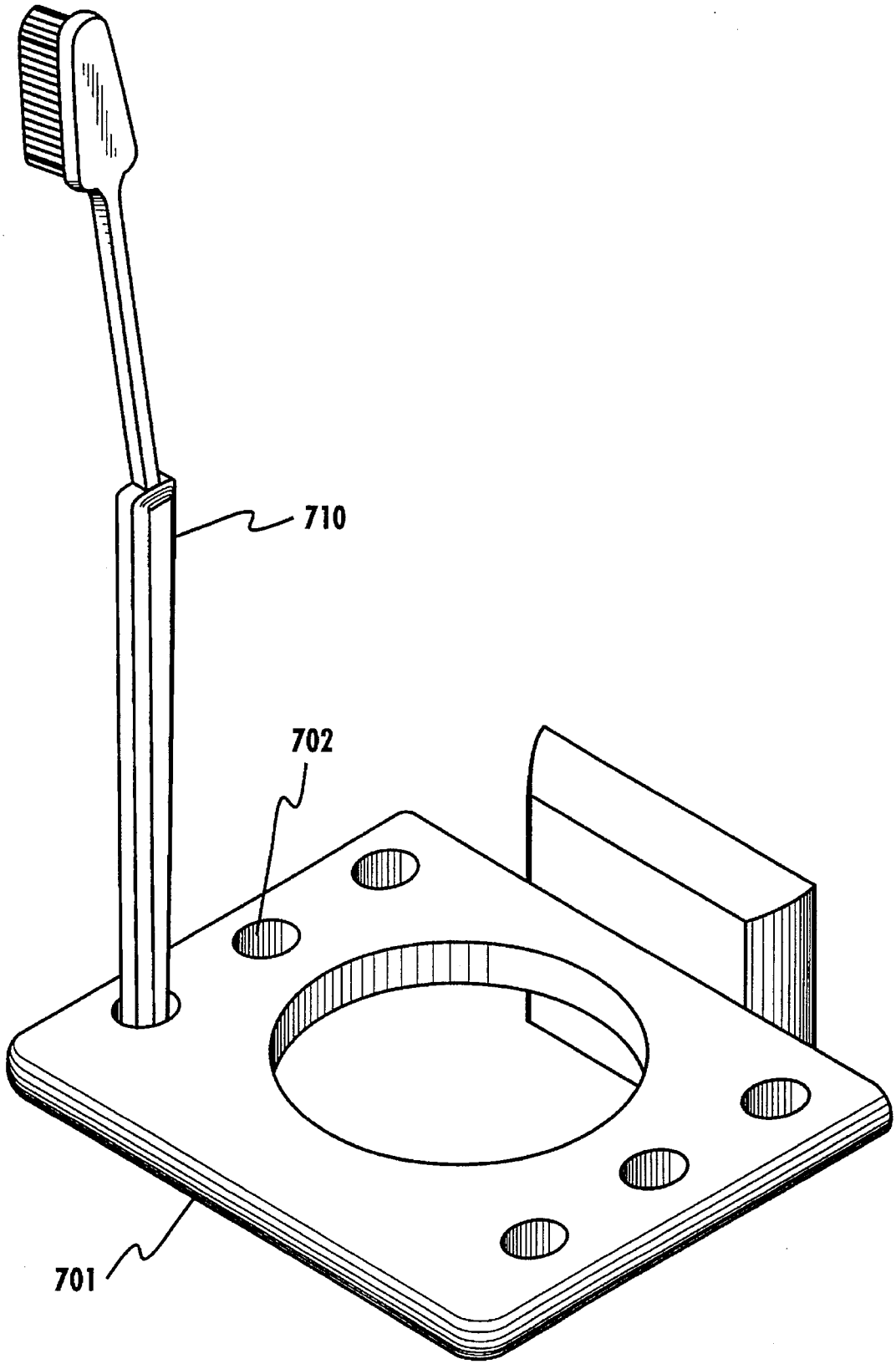
*Fig. 7 - Prior Art*

MODERN TOOTHBRUSH HOLDER

FIELD OF THE INVENTION

The present invention relates to a holder for devices such as toothbrushes. The present invention has particular application to modern toothbrush designs and may have particular application to marine and recreational vehicle (RV) use.

BACKGROUND OF THE INVENTION

The design of the toothbrush has changed dramatically in recent years. Traditional toothbrushes amounted to little more that a brush mounted on a plastic stick. However, manufacturers are now offering the public a bewildering array of toothbrush designs offering features such as angled handles or heads, flexible shafts, wear-indication bristles, comfort-molded handles, and even toothbrushes which glow in the dark. Many of these modern toothbrush designs have met with great acceptance with the general public.

Unfortunately, the prior art toothbrush holders prevalent in many homes may not be equipped to properly hold such modern toothbrush designs. A typical prior art toothbrush holder, illustrated in FIG. 7, may comprise a porcelain, metal wood or plastic holder 701, typically wall mounted, with a plurality of holes 702 for holding toothbrushes. Unfortunately, holes 702 may be sized for the traditional toothbrushes, which, as noted above generally comprise a straight shaft and bristles.

The molded handles of modern toothbrushes may not fit properly into a prior art toothbrush holder. As illustrated in FIG. 7, if modern toothbrush 710 is placed in prior art toothbrush holder 701, only a small portion of the handle of modern toothbrush 710 may actually protrude through hole 702 in prior art toothbrush holder 701.

As a result, the bulk of the mass of modern toothbrush 710 may be well above toothbrush holder 701 and thus be unstable. If accidently jostled, modern toothbrush 710 may fall onto the floor, accumulating germs, bacteria and dirt. In marine and RV applications in particular, the motions of a boat or RV may cause modern toothbrush 702 to become dislodged from a prior art toothbrush holder 701. Such a situation is unsanitary and contrary to good oral hygiene.

Table I is a list of popular modern toothbrush designs tested by the inventor with prior art toothbrush holders. The list in Table I is provided for the purposes of illustration to enhance understanding of the present invention and by no means is a exhaustive list of modern toothbrush designs as discussed above. Moreover, new toothbrush designs are continually introduced. The toothbrush holder of the present invention may be applied to older type, modern, and future toothbrush designs. In general, the term "modern toothbrush" as used for the purposes of this application, refers to any toothbrush or the like having a relatively large handle, narrower neck, and a head larger than the neck.

MODERN TOOTHBRUSH DESIGNS

1. AQUAFRESH™ FLEX DIRECT by Smith Line Beecham of Pittsburgh, Pa. 15230 (U.S. Pat. Nos. 5,052,071 and 5,054,154, incorporated herein by reference).
2. ORAL B #40 by ORAL-B Laboratories, Redwood City, Calif. 94065 (U.S. Pat. No. 4,802,255, incorporated herein by reference).
3. CREST™ COMPLETE #8 by Procter & Gamble, Cincinnati, Ohio (U.S. Pat. Nos. 4,637,660, 4,954,305, and 4,979,782, all incorporated herein by reference).
4. REACH #7130CJ, Dist. by Johnson & Johnson 5. REACH Advanced Design Toothbrush, Angled Neck, Rubber Grip #7203AM, Dist. by Johnson & Johnson
6. REACH Wonder Grip Youth #7206AH, Dist. by Johnson & Johnson
7. DENTAX Kids, Dist. by Oral Care Division of Carewell Industries, Inc.
8. CREST Complete, Compact Size #7, Dist. by Procter & Gamble, Cincinnati, Ohio
9. Colgate Precision #67, Dist. by Colgate-Palmolive Co. NY, New York, 10022.
10. HUGGER Triple Headed, Dist. by Dental Concepts, Inc. (U.S. Pat. Nos. D273,153 & D315,450, incorporated herein by reference).
11. COLGATE PLUS #27, Dist. by Colgate-Palmolive Co. NY, New York, 10022
12. TEK EXCEL, Dist. by Playtex Family Products Corp.
13. GUM ANGLE, Dist by John O. Butler Co.
14. PLAX, Pfizer, Inc., Dist by Oral Care Division of Pfizer Inc. NY, New York

TABLE I

Of the above fourteen toothbrushes tested in Table I, only number 14 (PLAX, by Pfizer, Inc.) was found by the present inventor to absolutely fit a prior art toothbrush holder. One intuitive approach to modifying prior art toothbrush holder 701 to accommodate modern toothbrush designs may be to enlarge the size of holes 702 in prior art toothbrush holder 701. However, such an approach may not work, as enlarged holes may allow the entire toothbrush to pass through prior art toothbrush holder 701 and fall to the floor.

Another alternative, practiced by many, is to use a drinking cup or the like as a toothbrush holder to hold modern toothbrushes which no longer fit in a prior art toothbrush holder. The practice of using a drinking cup as a toothbrush holder may be extremely unsanitary due to the buildup of paste, saliva, and water in the base of the cup. Moreover, A cup, when loaded with one or more toothbrushes, may become top-heavy and unstable, and the toothbrushes are again put at risk of falling on the floor. In addition, if more than one toothbrush is placed in the cup, a user must remove all toothbrushes before using the cup to drink from or rinse. As there may be no convenient place to place toothbrushes near a sink or vanity, the toothbrushes again run the risk of being dropped in or on the sink or vanity or falling to the bathroom floor.

A number of toothbrush holders are known in the art utilizing C-shaped, T-shaped or L-shaped slots. However, such designs may not securely hold a toothbrush against movement and vibration, particularly a modern toothbrush design. Such fixtures are shown, for example, in Cleverdon U.S. Pat. No. Des. 161,425, issued Jan. 2, 1951 and Masland U.S. Pat. No. 712,824, issued Nov. 4, 1902, both of which are incorporated herein by reference.

Cleverdon U.S. Pat. No. Des. 161,425 shows a number of slots and holes of differing shapes, However, as it is a Design Patent, it is difficult to determine whether these slots and hold are intended for a toothbrush or other device (e.g., razor). Although such slots may accommodate a modern toothbrush, it appears to the inventor that a toothbrush may be readily dislodged from such slots, as no mechanism is present to retain a modern toothbrush.

Masland U.S. Pat. No. 716, 824, shows a combined brush and drinking glass holder using a number of C-shaped slots to hold toothbrushes. Again, although such slots may accommodate a modern toothbrush, it appears to the inventor that a toothbrush may be readily dislodged from such slots, as no mechanism is present to retain a modern toothbrush. For example, if a modern toothbrush is accidently jostled such that it is rotated approximately 90 degrees, it appears that the toothbrush may slip out of the holder. Thus, while such slots may be used to hold a toothbrush, vibration, jostling or other movement may cause a toothbrush secured in such a holder to come loose and fall to the floor.

Thus, it remains a requirement in the art to provide a toothbrush holder design which may securely hold a modern toothbrush.

SUMMARY AND OBJECTS OF THE INVENTION

A toothbrush holder comprises a generally planar support plate having at least one L-shaped slot formed at the periphery thereof, the L-shaped slot has a necked portion for retaining the toothbrush. The L-shaped slot may have a major axis and a minor axis. The minor axis of the L-shaped slot may intersect the periphery of the support plate. The necked portion may be provided at a position on the major axis of the L-shaped slot, positioned approximately halfway along the major axis of the L-shaped slot.

In a second embodiment of the present invention, the L-shaped slot may be provided with a countersunk or counterbored portion provided along the major axis of the L-shaped slot to retain a toothbrush. The countersunk or counterbored portion may be provided at an end of the L-shaped slot furthest from the minor axis.

In a third embodiment of the present invention, a milled portion may be provided along the major axis of the L-shaped slot to retain a toothbrush. The milled portion may be provided at an end of the L-shaped slot furthest from the minor axis.

It is an object of the present invention to hold a toothbrush in a sanitary manner such that the bristles may not touch the holder.

It is a further object of the present invention to securely hold a toothbrush in a holder.

It is a further object of the present invention to securely hold a toothbrush in a holder such that it may be readily removed for use.

It is a further object of the present invention to securely hold a toothbrush in a holder such that it may not be readily dislodged due to accidental contact, vibration, movement or the like.

It is a further object of the present invention to securely hold a modern toothbrush having a relatively large diameter handle and a narrow neck.

BRIEF DESCRIPTIONS OF THE DRAWINGS

FIG. 7 is a perspective view of a prior art toothbrush holder illustrating the fit of a modern toothbrush in such a holder.

DETAILED DESCRIPTION OF THE INVENTION

Figure 3C:
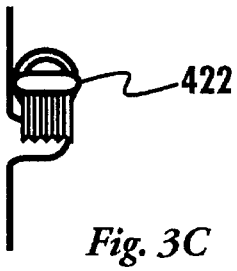
FIG. 3C is a partial top view of the first embodiment of the present invention illustrating the positioning of a toothbrush.
Figure 3A:
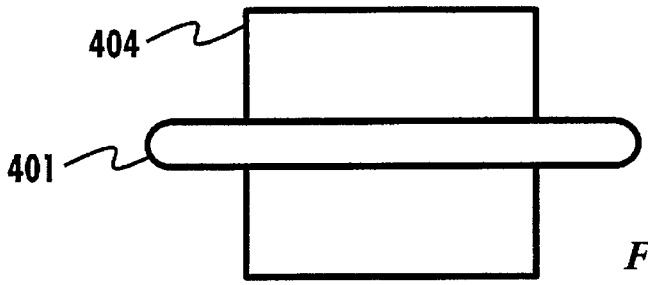
FIG. 3A is a frontal view of a first embodiment of the present invention.
Figure 3D:
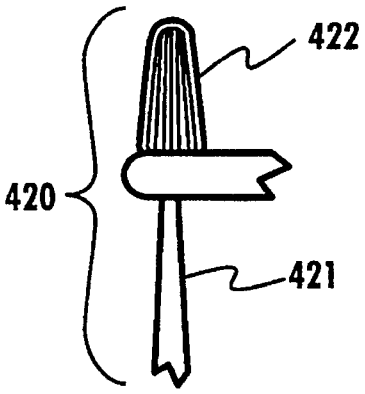
FIG. 3D is a partial front view of the present invention showing the positioning of a toothbrush.
Figure 3B:
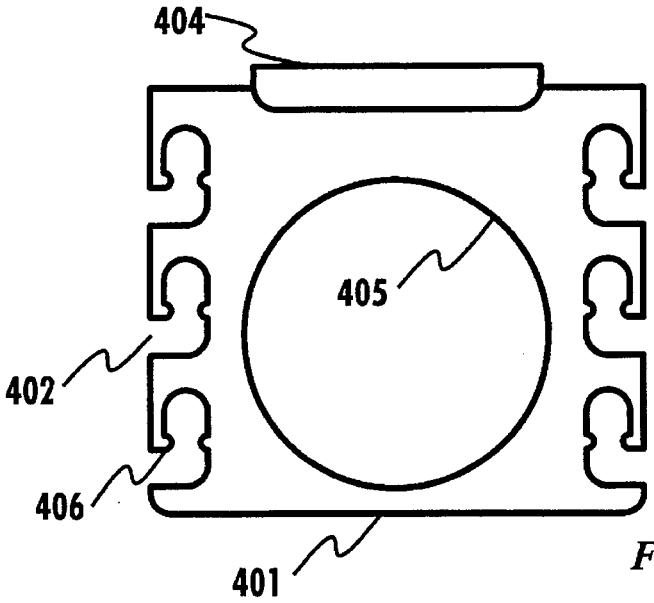
FIG. 3B is a top view of a first embodiment of the present invention.
Figure 3E:
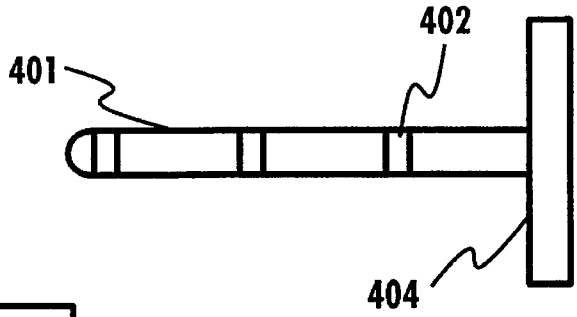
FIG. 3E is a side view of a first embodiment of the present invention.
Figure 3F:
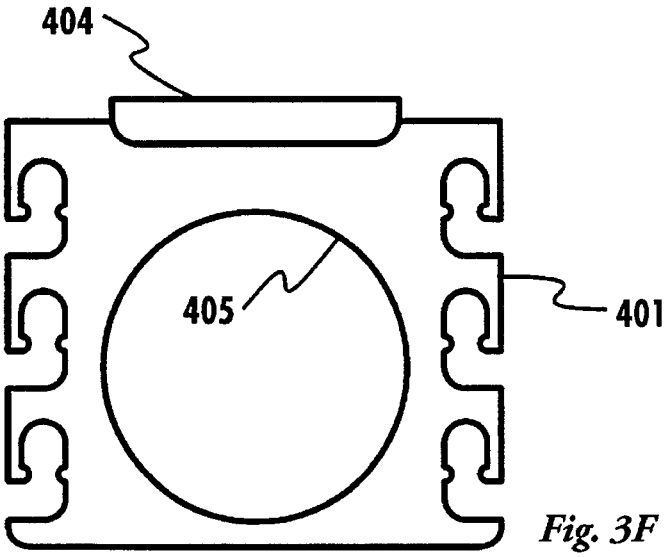
FIG. 3F is a bottom view of a first embodiment of the present invention.
Figure 4:
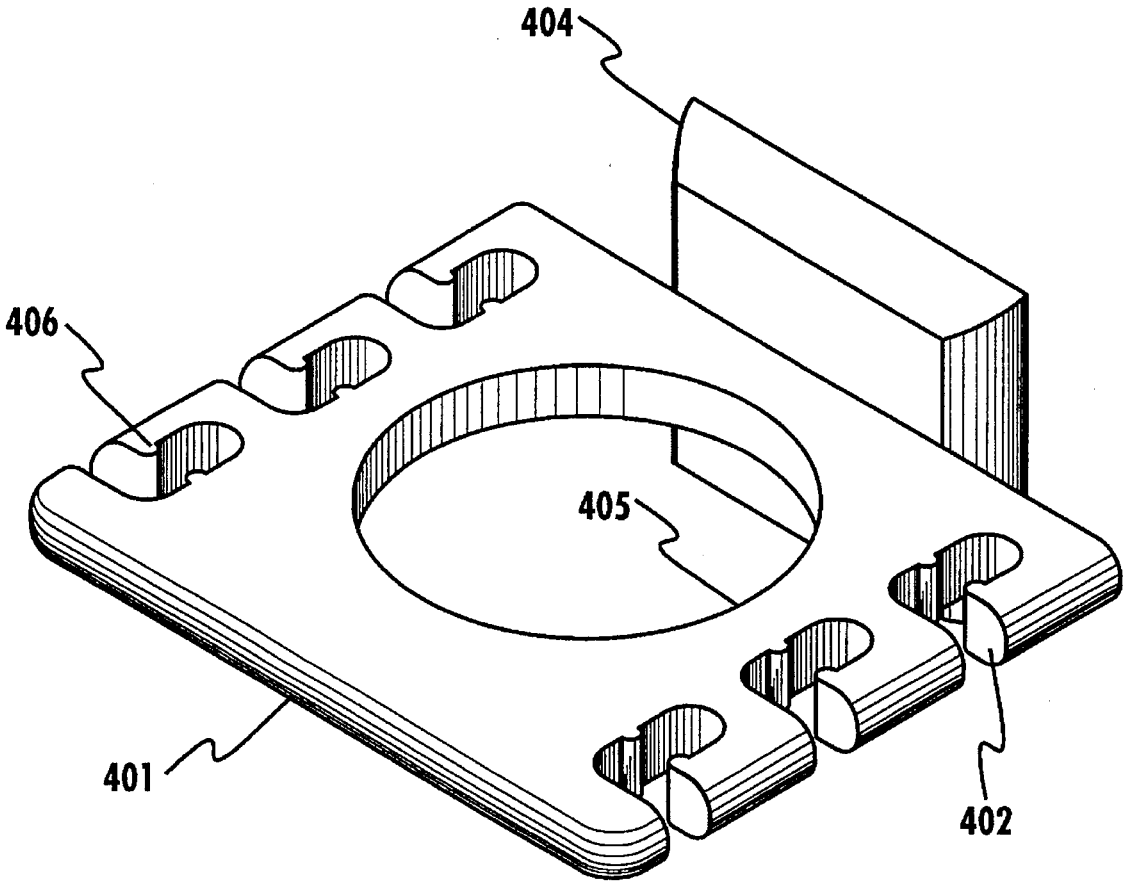
FIG. 4 is a perspective view of the first embodiment of the present invention.

FIGS. 3A–F and 4 illustrate a first embodiment of the present invention. As shown in FIG. 4, toothbrush holder 400 may comprise a wall mount base 404 and a support 401. Although illustrated here as a wall-mounted toothbrush holder, the toothbrush holder of the present invention may also be free-standing, floor, or sink mounted or the like, without departing from the spirit and scope of the present invention.

Wall mount base 404 may be attached to a wall using screws, adhesives or the like, as is known in the art. Wall mount base 404 and support 401 may be provided as separate elements attached together with fasteners, glue or the like, or may be provided as one integrated unit. Toothbrush holder 400 may be manufactured from a number of materials, including porcelain, metal, glass, wood, plastic, or the like.

Toothbrush holder 400 may be provided with a center cutout 405 for accepting a drinking glass or the like, or may be substantially planer. Alternately, a toothpaste tube holder or the like may be provided within the center of support 405. As the number of different toothpaste dispenser types has grown, a number of removable toothpaste dispenser holders may be provided for removably inserting into cup holder cutout 405.

Toothbrush holder 400 may be provided in any of a number of sizes and shapes, with any appropriate number of L-shaped slots 402 to accommodate an appropriate number of toothbrushes. the embodiment illustrated in FIGS. 3A–F and FIG. 4 may be provision for holding six toothbrushes, as is typical for a toothbrush holder designed for family use. Wall mount base 404 may be approximately 2½ inches in width and 2¼ inches tall and approximately ⅜ inch thick.

The rear surface of wall mount base 404 is substantially plain and forms no part of the present invention. Support 401 may be approximately 4¼ inches wide and 3⅝ inches long with an approximate thickness of ⅜ inch. These dimensions are provided for purposes of understanding the present invention and are in no way intended to limit the scope of the present invention.

Formed within support 401 is a number of L shaped slots 402 for accepting a toothbrush. Each of the L-shaped slots 402 may accommodate a toothbrush. In the preferred embodiment, each L-shaped slot 402 may be approximately ⅞ inch in is long axis and 0.408 inch is its short axis. The opening of each L-shaped slot 402 may be approximately 5/16 inch wide. The width of the long axis of L-shaped slot may be approximately ⅜ inch wide. Provided within L-shaped slot 402, midway along the long axis, is a necked portion 406. Necked portion 406 may have a width of approximately ¼ inch. The dimensions discussed herein are only for the purposes of illustration and other sizes may be utilized within the spirit and scope of the present invention to hold correspondingly sized articles.

FIGS. 3C and 3D illustrate the operation of the first embodiment of the toothbrush holder of the present invention. Despite the wide Variety in handle designs in modern toothbrushes, most generally have a neck thickness from 3/16 inch to ¼ inch. Thus, neck size is fairly standard among different modern toothbrush designs. The neck 421 of toothbrush 420 may be inserted into any one of L-shaped slots 402 and pushed along the long axis of slot 402 past necked portion 406. Once past necked portion 406, toothbrush 420 may rest within slot 402. Generally, head 422 of toothbrush 420 may rest on the edges of slot 401.

As toothbrushes are generally made of a fairly soft plastic, an slight interference fit between neck 421 and necked portion 406 may be acceptable. Once in place, toothbrush 420 is generally stable, as the bulk of the mass of toothbrush 420 is suspended below toothbrush holder 400. In addition, necked portion 406 may resist the movement of toothbrush 420 along the long axis of slot 402 due to vibrations or inadvertent contact. Head 422 of toothbrush 420 is kept sanitary, as toothbrush 420 is at reduce risk of being dropped on the floor. As toothbrush holder 400 allows toothbrush 420 to be inserted by the neck rather than by the base of the handle (as in the prior art) toothbrush holder 400 more readily accommodates modern handle designs.

FIGS. 1A–F and 2 illustrate a second embodiment of the present invention. The second embodiment of the present invention incorporates all of the features of the first embodiment of the present invention, but in addition includes countersinking to improve toothbrush retention. For the sake of clarity all of the elements of the first embodiment of the present invention in common with the second embodiment of the present invention need not be recited here.

Figure 2:
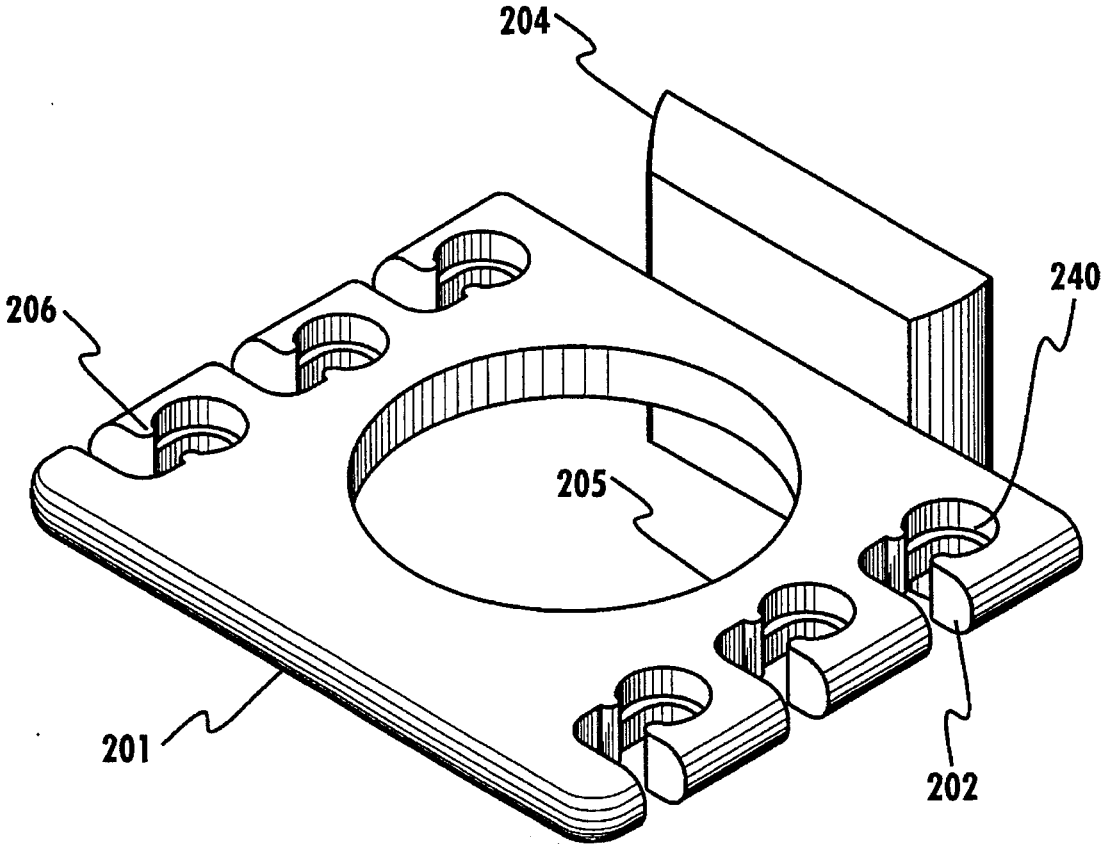
FIG. 2 is a perspective view of the second embodiment of the present invention.

As illustrated in FIG. 2, toothbrush holder 200 may be provided with a number of L-shaped countersunk slots 202 each having a necked portion 206. Past necked portion 206 in the far side of L-shaped countersunk slot 202 is countersunk portion 240. Countersunk portion 240 may have a nominal width of ⅜ inch as in the first embodiment, but countersunk at a diameter of approximately 9/16 inch. In the preferred embodiment, countersunk portion 240 may be countersunk to more than half the thickness of support 201. Although illustrated as countersunk, countersunk portion 240 may be counterbored as well such that the portion between the diameter of the counterbore and the nominal width of L-shaped countersunk slot 202 is not tapered. Furthermore, although described herein as counterbored or countersunk, countersunk portion 240 may be formed using any one of a number of processes (e.g., molding, forming, shaping or the like). In the preferred embodiment of the present invention, it is envisioned that the toothbrush holder may be formed from metal, plastic or porcelain using a casting type process to form L-shaped slots 202 and countersunk/counterbored portions 240.

Figure 1C:
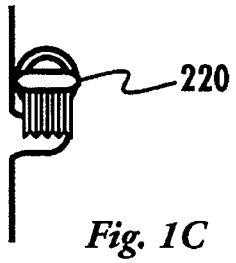
FIG. 1C is a partial top view of the second embodiment of the present invention illustrating the positioning of a toothbrush.
Figure 1A:
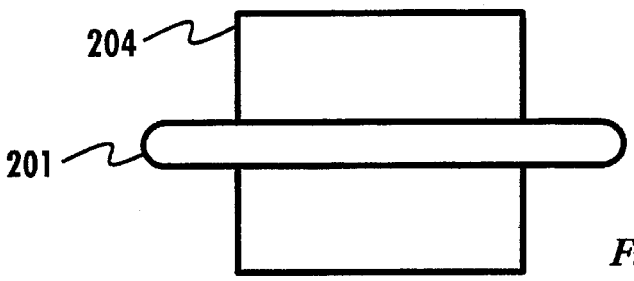
FIG. 1A is a frontal view of a second embodiment of the present invention.
Figure 1D:
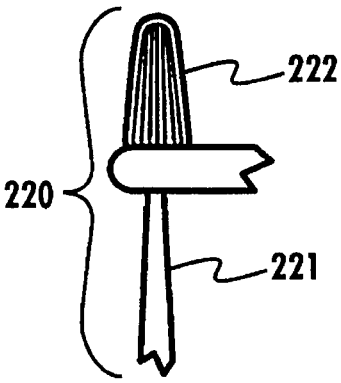
FIG. 1D is a partial front view of the present invention showing the positioning of a toothbrush.
Figure 1B:
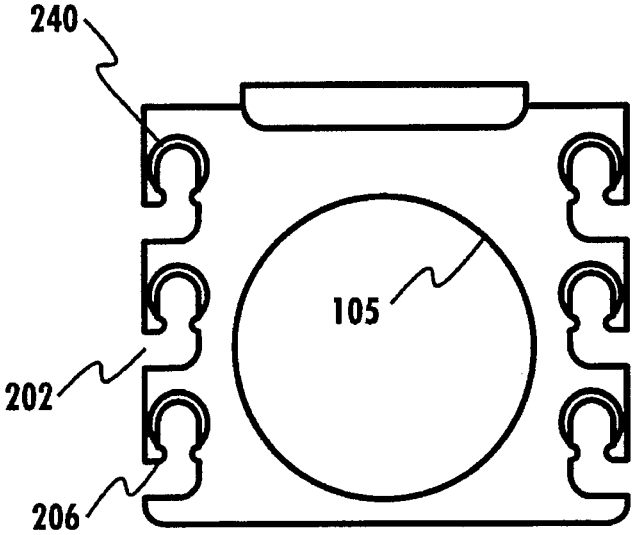
FIG. 1B is a top view of a second embodiment of the present invention.
Figure 1E:
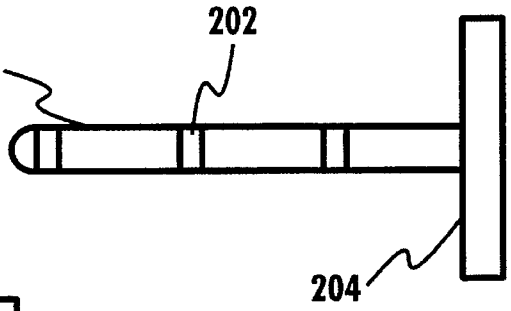
FIG. 1E is a side view of a second embodiment of the present invention.
Figure 1F:
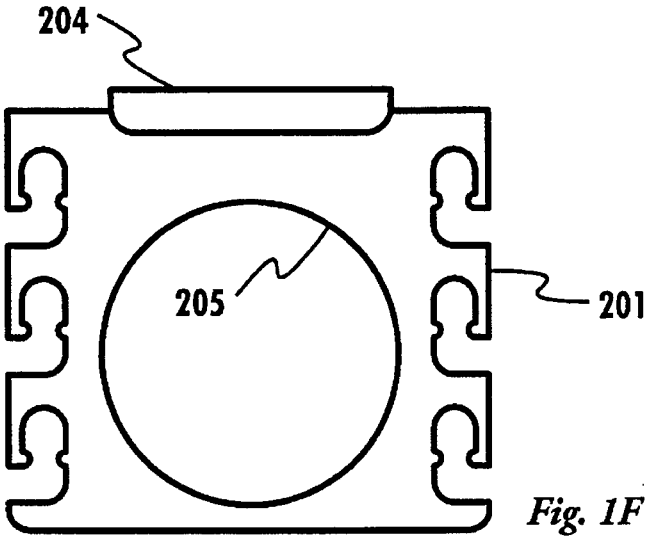
FIG. 1F is a bottom view of a second embodiment of the present invention.

FIGS. 1C and 1D illustrate the positioning of a toothbrush 220 within L-shaped countersunk slot 202. Countersunk portion 240 serves to accept a portion of the head 222 of toothbrush 220, such that head 220 rests snugly within countersunk portion 240. To insert toothbrush 220 into L-shaped countersunk slot 202, a user must push neck 221 of toothbrush 220 past necked portion 206 and then allow head 222 to drop into countersunk portion 240. to remove toothbrush 220, head 222 must be lifted above countersunk portion 240 and neck 221 passed through necked portion 206.

Be partially recessing head 222 into countersunk portion 240, toothbrush holder 200 may further resist the influence of outside disturbances to dislodge toothbrush 220. the second embodiment of the present invention may have particular application in marine and RV environments, where vehicle vibration and movement may serve to dislodge toothbrushes and the like. Testing has shown that the second embodiment of the present invention requires fairly severe movement to accidently dislodge toothbrush 220 from toothbrush holder 200.

FIGS. 5A–F and 6 illustrate a third embodiment of the present invention. The third embodiment of the present invention incorporates all of the features of the first embodiment of the present invention, but in addition includes a milled portion to improve toothbrush retention. For the sake of clarity all of the elements of the first embodiment of the present invention in common with the third embodiment of the present invention need not be recited here.

Figure 6:
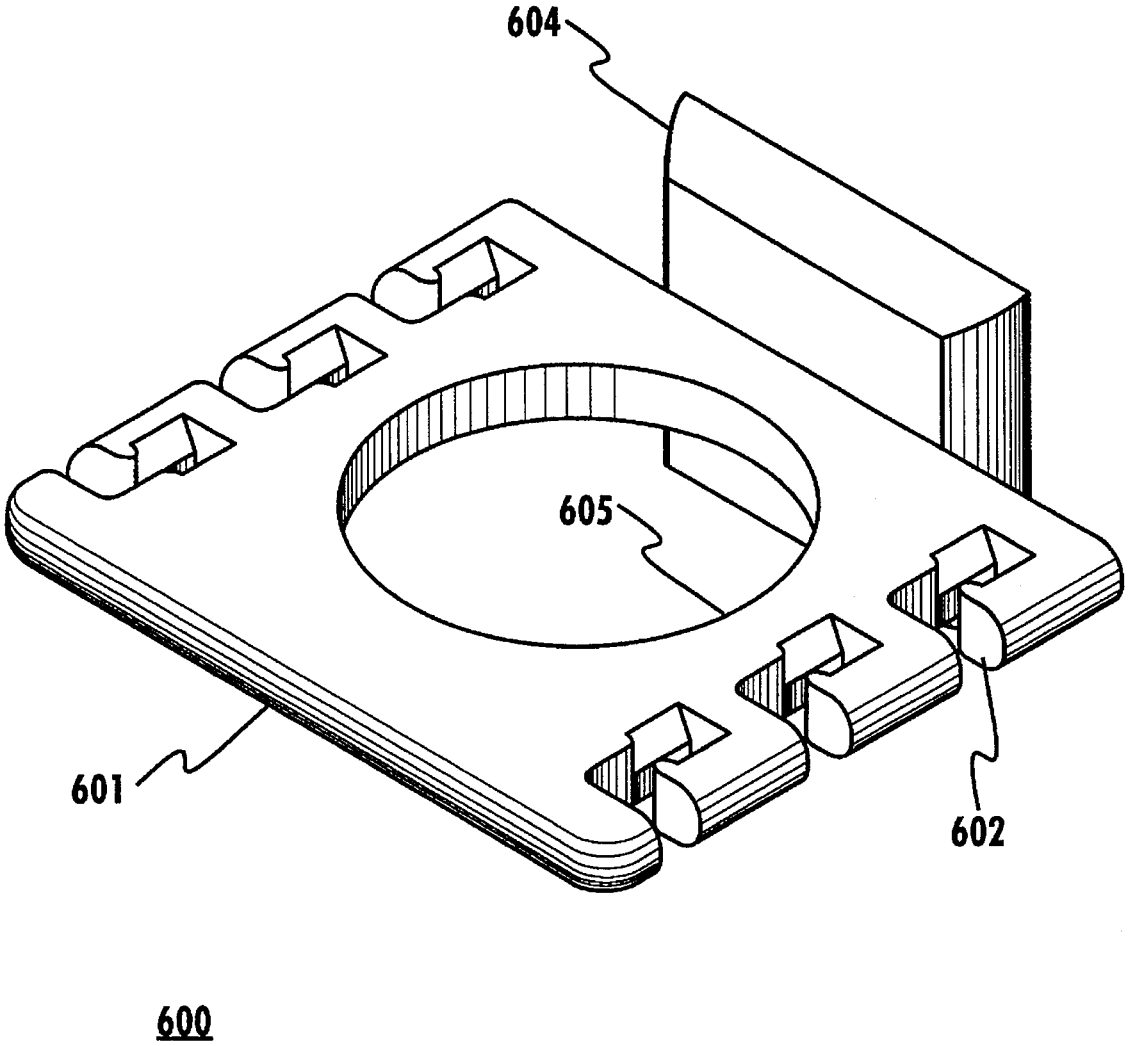
FIG. 6 is a perspective view of the third embodiment of the present invention.

As illustrated in FIG. 6, toothbrush holder 600 may be provided with a number of L-shaped milled slots 602. On the far side of L-shaped countersunk slot 602 is milled portion 640. Milled portion 640 may have a nominal width of ⅜ inch as in the first embodiment, but milled at a width of approximately 9/16 inch and a length of approximately ⅝ inch. In the preferred embodiment, milled portion 640 may be milled to more than half the thickness of support 601. Although described herein as being milled, milled portion 640 may be suitably machined, molded or otherwise formed so as to form a substantially rectangular recessed portion for accepting a toothbrush head. In the preferred embodiment of the present invention, it is envisioned that the toothbrush holder may be formed from metal, plastic or porcelain using a casting type process to form L-shaped slots 602 with milled portions 640.

Figure 5C:
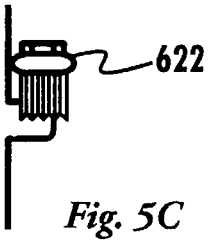
FIG. 5C is a partial top view of the third embodiment of the present invention illustrating the positioning of a toothbrush.
Figure 5A:
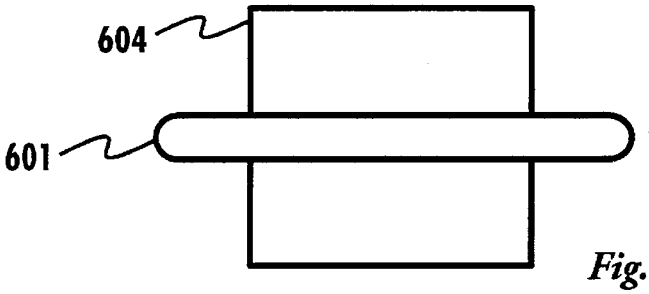
FIG. 5A is a frontal view of a third embodiment of the present invention.
Figure 5D:
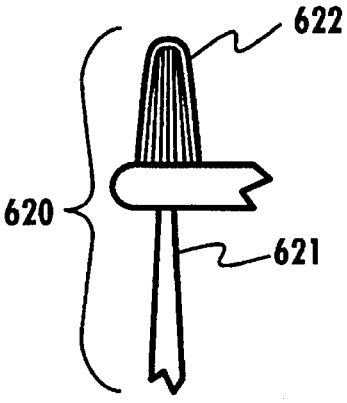
FIG. 5D is a partial front view of the present invention showing the positioning of a toothbrush.
Figure 5B:
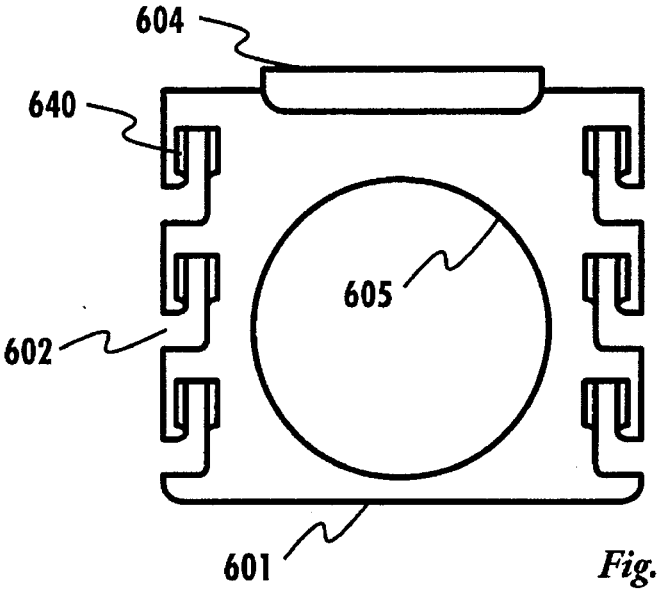
FIG. 5B is a top view of a third embodiment of the present invention.
Figure 5E:
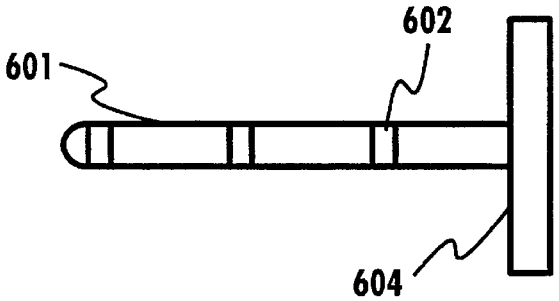
FIG. 5E is a side view of a third embodiment of the present invention.
Figure 5F:
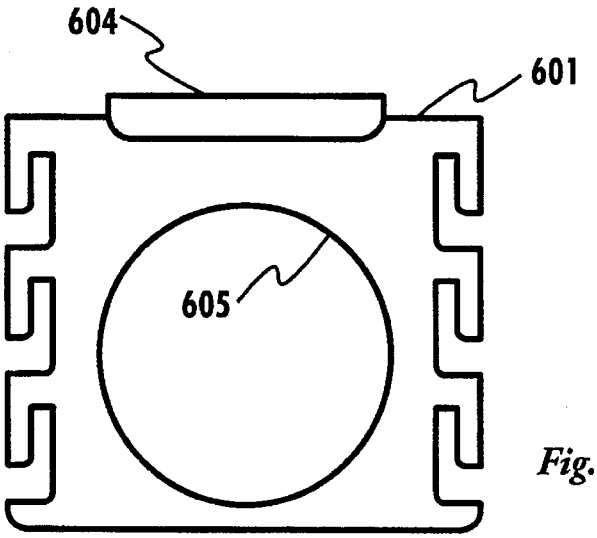
FIG. 5F is a bottom view of a third embodiment of the present invention.

FIGS. 5C and 5D illustrate the positioning of a toothbrush 620 within L-shaped milled slot 602. Milled portion 640 serves to accept a portion of the head 622 of toothbrush 620, such that head 620 rests snugly within milled portion 640. To insert toothbrush 620 into L-shaped milled slot 602, a user must push neck 621 of toothbrush 620 past necked portion 606 and then allow head 622 to drop into milled portion 640. to remove toothbrush 620, head 622 must be lifted above milled portion 640 and neck 621 passed through necked portion 606.

Be partially recessing head 622 into milled portion 640, toothbrush holder 600 may further resist the influence of outside disturbances to dislodge toothbrush 620. the third embodiment of the present invention may have particular application in marine and RV environments, where vehicle vibration and movement may serve to dislodge toothbrushes and the like. Testing has shown that the third embodiment of the present invention requires fairly severe movement to accidently dislodge toothbrush 620 from toothbrush holder 600.

While the preferred embodiment and various alternative embodiments of the invention have been disclosed and described in detail herein, it may be apparent to those skilled in the art that various changes in form and detail may be made therein without departing from the spirit and scope thereof.

For example, while illustrated here for use in holding toothbrushes, the apparatus of the present invention may be similarly utilized to hold other types of utensils, tools, and the like. For example, the size and shapes of slots may be altered to hold other types of dental tools or the like having a thin neck portion in relationship to their heads (e.g., dental mirror).

Moreover, various modifications may be made within the spirit and scope of the present invention. For example, the second embodiment of the present invention may be provided without the necked portion, relying upon the countersunk/counterbored portions to secure a toothbrush. Similarly, the third embodiment of the present invention may be provided with a necked portion in addition to the milled portion to more securely retain a toothbrush. Moreover, the shape and size of the milled portion or L-shaped slots may be altered to provide additional toothbrush head clearance and/or enhanced ornamental design to the toothbrush holder.

What is claimed is:

1. A device for holding a toothbrush comprising:

a generally planar support plate; and at least one substantially L-shaped slot formed at a periphery of the generally planar support plate, said substantially L-shaped slot having a major axis and a minor axis, the minor axis of said substantially L-shaped slot intersecting the periphery of said generally planar support plate, said substantially L-shaped slot further being provided with a recessed portion provided along said major axis of the substantially L-shaped slot to retain the toothbrush; wherein the recessed portion is provided substantially at an end of said substantially L-shaped slot furthest from said minor axis.

2. The device of claim 1, wherein said necked portion may be provided at a position on said major axis of said substantially L-shaped slot substantially halfway along said major axis of the substantially L-shaped slot.

3. The device of claim 2 wherein said substantially L-shaped slot has a width of substantially ⅜ inch.

4. The device of claim 3 wherein said necked portion of said substantially L-shaped slot has a width of substantially ¼ inch.

5. The device of claim 4, wherein a length of said substantially L-shaped slot along said major axis is substantially ⅞ inch.

6. The device of claim 5, wherein a length of said substantially L-shaped slot along said minor axis is substantially 0.4 inches.

7. A device for holding a toothbrush comprising:

a generally planar support plate; and at least one substantially L-shaped slot formed at a periphery of the generally planar support plate, said substantially L-shaped slot having a major axis and a minor axis, the minor axis of said substantially L-shaped slot intersecting the periphery of said generally planar support plate, said substantially L-shaped slot further being provided with a circular recessed portion provided along said major axis of the substantially L-shaped slot to retain the toothbrush;

wherein the circular recessed portion is provided substantially at an end of said substantially L-shaped slot furthest from said minor axis.

8. The device of claim 7, wherein said circular recessed portion is recessed to a depth at least half the thickness of said generally planar support plate.

9. The device of claim 8, wherein said substantially L-shaped slot further comprises a necked portion for further retaining the toothbrush.

10. The device of claim 9, wherein said substantially L-shaped slot has a width of substantially ⅜ inch.

11. The device of claim 10, wherein said necked portion of said substantially L-shaped slot has a width of substantially ¼ inch.

12. The device of claim 11, wherein a length of said substantially L-shaped slot along said major axis is substantially ⅞ inch.

13. The device of claim 12, wherein a length of said substantially L-shaped slot along said minor axis is substantially 0.4 inches.

14. The device of claim 13, wherein said circular recessed portion has a diameter of substantially 9/16 inches.

15. A device for holding a toothbrush comprising:

a generally planar support plate; and at least one substantially L-shaped slot formed at a periphery of the generally planar support plate, said substantially L-shaped slot having a major axis and a minor axis, the minor axis of said substantially L-shaped slot intersecting the periphery of said generally planar support plate, said substantially L-shaped slot further being provided with a substantially rectangularly recessed portion provided along said major axis of said substantially L-shaped slot to retain the toothbrush;

wherein said substantially rectangularly recessed portion is provided at an end of said substantially L-shaped slot furthest from the minor axis.

16. The device of claim 15, wherein said substantially rectangularly recessed portion is recessed to a depth at least half the thickness of said generally planar support plate.

17. The device of claim 16, wherein said substantially rectangularly recessed portion is recessed to a substantially rectangular shape so as to accommodate a toothbrush head.

18. The device of claim 17, wherein said substantially L-shaped slot further comprises a necked portion for further retaining the toothbrush.

19. The device of claim 18, wherein said substantially L-shaped slot has a width of substantially ⅜ inch.

20. The device of claim 19, wherein said necked portion of said substantially L-shaped slot has a width of substantially ¼ inch.

21. The device of claim 20, wherein a length of said substantially L-shaped slot along said major axis is substantially ⅞ inch.

22. The device of claim 21, wherein a length of said substantially L-shaped slot along said minor axis is substantially 0.4 inches.

23. The device of claim 22, wherein said substantially rectangularly recessed portion has a width of substantially 9/16 inches.

24. The device of claim 23, wherein said substantially rectangularly recessed portion has a length of substantially ⅝ inches.

* * * * *